US006668040B2

(12) United States Patent
Cederstrom

(10) Patent No.: US 6,668,040 B2
(45) Date of Patent: Dec. 23, 2003

(54) REFRACTIVE X-RAY ARRANGEMENT

(75) Inventor: Bjorn Cederstrom, Trelleborg (SE)

(73) Assignee: Mamea Imaging AB, Stockholm (SE)

( * ) Notice: Subject to any disclaimer, the term of this patent is extended or adjusted under 35 U.S.C. 154(b) by 0 days.

(21) Appl. No.: 10/043,692

(22) Filed: Jan. 10, 2002

(65) Prior Publication Data

US 2002/0159561 A1 Oct. 31, 2002

Related U.S. Application Data

(63) Continuation of application No. PCT/SE00/01502, filed on Jul. 17, 2000.
(60) Provisional application No. 60/144,523, filed on Jul. 19, 1999.

(51) Int. Cl.[7] ..... G21K 1/06
(52) U.S. Cl. ..... 378/84
(58) Field of Search ..... 378/84, 85, 145, 378/70

(56) References Cited

U.S. PATENT DOCUMENTS

| | | | | |
|---|---|---|---|---|
| 4,860,328 A | | 8/1989 | Frankel et al. | |
| 4,870,653 A | | 9/1989 | Sher et al. | |
| 5,438,454 A | * | 8/1995 | Ludewigt et al. | 36/165 |
| 5,684,852 A | * | 11/1997 | Tomie | 378/145 |
| 6,091,798 A | * | 7/2000 | Nygren et al. | 378/145 |

* cited by examiner

*Primary Examiner*—Toan Ton
*Assistant Examiner*—Richard Kim
(74) *Attorney, Agent, or Firm*—Oppedahl & Larson LLP

(57) ABSTRACT

The present invention refers to a refractive arrangement for X-rays, and specially to a lens comprising: a member of low-Z material, said member of low-Z material having a first end adapted to receive x-rays emitted from an x-ray source and a second end from which emerge said x-rays received at said first end. It further comprises a plurality of substantially saw-tooth formed grooves disposed between said first and second ends, said plurality of grooves oriented such that said x-rays which are received at said first end, pass through said member of low-Z material and said plurality of grooves, and emerge from said second end, are refracted to a focal point.

30 Claims, 4 Drawing Sheets

REFRACTIVE X-RAY ARRANGEMENT

This application is a continuation of International Application No. PCT/SE00/01502 filed on Jul. 17, 2000 claims the benefit of U.S. Provisional Application No. 60/144,523 filed on Jul. 19, 1999.

TECHNICAL FIELD

The present invention relates to x-rays and, more specifically, to X-ray focussing using a refractive X-ray arrangement. The refractive arrangement for X-rays comprises a member of low-Z material, said part of low-Z material having a first end adapted to receive x-rays emitted from an x-ray source and a second end from which emerge said x-rays received at said first end, and first and second surfaces. The invention also concerns a lens and a method for manufacturing the arrangement.

BACKGROUND OF THE INVENTION

With the advent of $3^{rd}$ generation synchrotron x-ray sources, hard x-ray optics is a field of growing interest with applications in research, material testing, chemical analysis and medical imaging and therapy. Prior art focusing elements in this energy region use the methods of reflection and diffraction, e.g. best crystals, curved mirrors, Fresnel zone plates and capillary optics. These elements are generally expensive and technologically challenging to manufacture, limiting their use in commercial-grade applications.

Another shortcoming associated with prior art high-energy x-ray focusing techniques, such prior art attempts are limited to generating a single-peak energy distribution. Hence, such experimental methods are not well suited to applications requiring more than one x-ray energy peak, such as dual-energy x-ray imaging.

PRIOR ART

It is well known that the refractive index of any material can be expressed by $$n=1-\delta-i\beta \tag{1}$$

Refractive lenses can easily be fabricated for use in the visible light region, since materials having a refractive index n far from unity and a small absorption in this region are readily available. In contrast, optical elements utilizing refraction are intrinsically difficult to fabricate for use in the x-ray region, since in this energy region, all materials have an index of refraction n near unity and exhibit a large absorption. Consider a concave piece of material having a circular revolution with the radius of curvature R. Such a piece of material will focus a plane-wave entering parallel to the axis at a focal distance of f. The focal length is given by $$f=\frac{R}{\delta} \tag{2}$$

A lens fabricated according to eq. 2 would have a very large focal length, since d is typically $10^{-5}$ or $10^{-6}$ in the hard x-ray region. Examples of such lenses were given by Suehiro et al (Nature 352 (1991), pp. 385–386). In a correspondence, this approach was ruled out for any practical application by Michette (Nature 353 (1991), p. 510). The extent to which the focal length can be shortened by reducing R has limitations in terms of fabrication technology and practical use.

A significant improvement was achieved when Snigirev et at (Nature 384 (1996), pp. 49–51) cascaded N drilled holes in a piece of aluminum. This corresponds to 2N concave surfaces, thereby reducing the focal length by the same factor. The total focal length of the compound lens is given by $$F=\frac{f}{2N}=\frac{R}{2\delta N} \tag{3}$$

This lens still suffered from spherical aberration and high absorption and focusing was only achieved in one dimension. These shortcomings have been addressed by several authors. Similar solutions are also known through U.S. Pat. No. 5,594,773 and U.S. Pat. No. 5,684,852.

Low-Z materials have been used for decreased absorption and two-dimensional focusing has been achieved by, e.g. Elleaume Nucl. Instr. and Meth. A 412 (1998), pp. 483–506) by means of crossing two linear arrays.

Another lens is described in a U.S.A Patent Application entitled "A COMPOUND REFRACTIVE X-RAY LENS", now U.S. Pat. No. 6,091,798, which discloses a novel manufacturing technique to make parabolic profiles by splitting the lens in two halves at the symmetry axis, thereby reducing spherical aberration and absorption.

However, aberration free compound reflective x-ray lenses still rely on elaborate and expensive manufacturing techniques. Hence, such refractive lenses are not well suited to commercial-grade applications. Furthermore, such prior art refractive x-ray lenses are limited to generating a single-peak energy distribution. As yet another disadvantage, prior art refractive x-ray lenses have, for a given energy, a fixed focal length, which cannot be varied.

SUMMARY OF THE INVENTION

Thus, a need exists for a refractive x-ray lens, which is well suited for commercial applications and which does not suffer from the disadvantageous inherited by the known lense. Still another need exists for a refractive x-ray lens, which is able to generate a dual energy distribution from an x-ray source. Yet another need exists for a refractive x-ray lens for which the focal length for a given energy can easily be varied. Still, another need exists for a high-energy x-ray leas able to generate a dual energy distribution from a broadband x-ray source.

A further need exists for a method readily to form a refractive x-ray lens at a low cost, e.g. so that high-energy x-ray optics should find its way from specialized research facilities into general applications in industry and commercial R&D.

The present invention provides an x-ray lens which is well suited for commercial applications. The present invention further provides a method readily to form a compound refractive x-ray lens. The present invention also provides a refractive x-ray lens able to generate a dual-energy distribution from a broad energy x-ray source. Furthermore, the present invention provides an x-ray lens for which the focal length for a given energy can easily be varied. The present invention achieves the above accomplishments with a novel x-ray focusing apparatus, novel x-ray lens formation methods and novel methods for focusing of x-rays.

Moreover, the present invention has as an objective to increase the flux on a scanned slit. For these reasons, the initially mentioned refractive arrangement for X-rays further comprises a plurality of substantially sawtooth formed grooves disposed between said first and second ends on at least one of said first or second surfaces. Said plurality of grooves oriented such that said x-rays which are received at said first end, pass through said member of low-Z material and said plurality of grooves, and emerge from said second end, are refracted to a focal point.

Preferably, said member of low-Z material consists of a plastic material, specially one of from the group comprising polymethylmethacrylate, vinyl and PVC. It may also consist of beryllium.

Preferably, said grooves have the form of sawteeth with substantially straight cuts.

In an advantageous embodiment said pluralities of grooves have varying sizes, decreasing or increasing continuously from said first end towards said second end.

The refractive X-ray lens according to the invention comprises a volume of low-Z material, said volume having a first end adapted to receive x-rays emitted from an x-ray source and a second end from which emerge said x-rays received at said first end and first and second surfaces. The volume further comprises a plurality of substantially saw-tooth formed grooves disposed between said first and second ends on at least one of said at least two surface, said plurality of grooves oriented such that said x-rays which are received at said first end, pass through said volume of low-Z material and said plurality of grooves, and emerge from said second end, are refracted to a focal point.

In one advantageous embodiment the lens comprises two volumes arranged such that the surfaces with the plurality of grooves are facing each other. Preferably, said two volumes each have a tilt angle to an optical axis of said X-ray. Said volumes have non-coincident focal points.

Preferably, a focal length of each of the two volumes of the lens is varied by separately varying each tilt angle.

Said volume of low-Z material consists of a plastic material, specially one from the group comprising polymethylmethacrylate, vinyl and PVC or said volume of low-Z material consists of beryllium.

Moreover, the invention concerns an X-ray system and a method for two-dimensional focusing of X-rays and including at least two leases according to above. The focusing is obtained by arranging said at least two lenses, such that each x-ray traverses both of lenses in sequence and that one of said at least two lenses are rotated around an optical axis with respect to the other lens.

In one preferred application said refractive lens is coupled to at least one second commercial-grade compound refractive x-ray lens such that an array of compound refractive x-ray lenses is formed.

The method of fabricating the saw-tooth profile refractive x-ray lens is characterized by: transferring shapes of grooves onto a carrier by means of an engraving arrangement producing a master, and using said master to pressing grooves on a suitable material.

These and other advantages of the present invention will no doubt become obvious to those of ordinary skill in the art after having read the preferred embodiments which are illustrated in the various drawing figures.

BRIEF DESCRIPTION OF THE DRAWINGS

The present invention will become more fully apparent from the appended claims and the description as it proceeds in connection with the drawings illustrating some preferred embodiments of the invention. In the drawings:

BASIC THEORY

Figure 7:
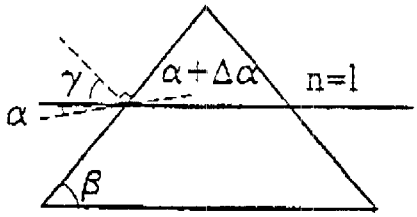
FIGS. 7 to 9 show representations of a sawtooth given for theocratical explanations.

In the following well-known ray-optics is applied to a sawtooth geometry. The thin lens approximation is made. The definitions are illustrated in FIG. 7 illustrating a substantially triangular sawtooth.

The law of refraction yields $$\sin(\gamma+\alpha)=n\sin(\gamma+\alpha+\Delta\alpha) \quad \text{(i)}$$

Since $\Delta\alpha$ is very small and $\alpha>>\gamma$, this can be written $$\sin(\gamma+\alpha)=n\sin(\gamma+\alpha)+n\cos(\gamma+\alpha)\Delta\alpha \quad \text{(ii)}$$

$$\Delta\alpha=\frac{(1-n)\sin(\gamma+\alpha)}{n\cos(\gamma+\alpha)}\approx\delta\tan(\gamma)=\frac{\delta}{\tan(\beta)} \quad \text{(iii)}$$

where $n=1-\delta$ and $\beta+\gamma=\pi/2$.

Figure 8:
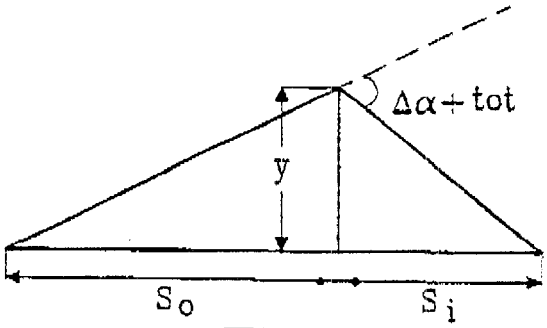

After passage of N sawteeth the total deflection angle will be $$\Delta\alpha_{tot}=2N\,\delta/\tan(\beta) \quad \text{(iv) (see also FIG. 8)}$$

This angle is so small that it will be assumed that the ray will traverse the lens in a straight line parallel to the axis. The geometry above shows that $$\Delta\alpha_{tot}(y)=\frac{y}{s_o}+\frac{y}{s_i}\equiv\frac{y}{f} \quad \text{(v)}$$

where f is the focal length of the compound lens.

Combination of (iv) and (v) gives the number of teeth seen by a ray at a distance y from the axis, $$N(y)=\frac{\tan(\beta)\Delta\alpha_{tot}}{2\delta}=\frac{y\tan(\beta)}{2\delta f} \quad \text{(vi)}$$

The distance a ray has to travel before seeing an additional tooth can be calculated from $$y(N)=\frac{2N\delta f}{\tan(\beta)}\Rightarrow y(i)-y(i-1)=\frac{2\delta f}{\tan(\beta)} \quad \text{(vii)}$$

and an additional path length is obtained in the material $$x(y) = \frac{2y}{\tan(\beta)} \Rightarrow \Delta x = x(i) - x(i-1) = \frac{4\delta f}{\tan^2(\beta)} \quad \text{(viii)}$$

The total path-length follows from summation of all contributions:

$$\begin{aligned} X(y) &= \Delta x(1 + 2 + \ldots + N(y)) \quad \text{(ix)} \\ &= \Delta x \frac{1}{2}[N(y)]^2 \\ &= \frac{4\delta f}{\tan^2(\beta)} \frac{1}{2}\left(\frac{y\tan\beta}{2\delta f}\right)^2 \\ &= \frac{y^2}{2\delta f} \end{aligned}$$

Thus, it is shown that the path-length as a function of y will be parabolic. If y is the height of the first and largest tooth, the radius of curvature is R=δf . In reality, it is not a continuous function since a finite number of sawteeth exist, and the parabola will be approximated by a few hundred straight lines. This could give a perceptible aberration effects in some imaging applications, However, the effect should be small and neglectable.

Considering the case of a finite source perfectly projected onto a slit with size $d_s$. The attenuation length is denoted λ. A ray that has lateral displacement y is attenuated by a factor.

$$\exp\left(\frac{-X(y)}{\lambda}\right) = \exp\left(-\frac{y^2}{2\delta f\lambda}\right) \quad \text{(x)}$$

Thus, the rms beam spread is $$\delta = \sqrt{\delta f \lambda} \quad \text{(xi)}$$

The gain will be a product of the geometrical gain and the transmission through the lens.

$$\begin{aligned} G(y_d) &= \frac{2y_d}{d_s}\frac{s_0 + s_i}{s_0}\frac{1}{y_d}\int_0^{y_d} \exp\left(-\frac{y^2}{2\sigma^2}\right)dy \\ &= \frac{2(1 + M_y)}{d_s}\frac{2}{\sqrt{\pi}}\frac{\sqrt{\pi}}{2}\int_0^{\frac{y_d}{\sqrt{2}\sigma}} \exp(-\xi^2)\sqrt{2}\,\sigma d\xi \\ &= \frac{1 + M_y}{d_s}\sqrt{2\pi}\,\sigma \cdot erf\left(\frac{y_d}{\sqrt{2}\,\sigma}\right) \end{aligned}$$

$M_y$ is the lateral magnification and the error function is used:

$$\mathrm{erf}(z) = \frac{2}{\sqrt{\pi}}\int_0^z \exp(-x^2)dx \quad \text{(xii)}$$

The error function will approach unity when the height is increased, and in the limiting $y_d \rightarrow \infty$, $$G_{\max} = \sqrt{2\pi}\,(1 + M_y)\frac{\sigma}{d_s} \quad \text{(xiii)}$$

This is evidently an unphysical limit. However, the error-function approaches unity quickly. The growth of the length of the lens quadratically with $y_d$ will not contribute much for a fixed focal length. Since the length should be kept down for practical and economical reasons.

Figure 9:
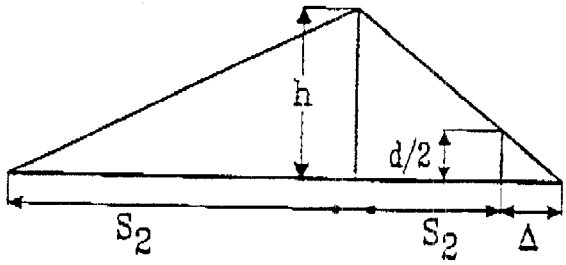

Once the geometry and lens parameters are fixed, the system will be optimized for one single energy. Calculating the gain in this case is less straightforward. Assuming that the beam from a point source on the optical axis is focused at $s_1+\Delta$, it follows that (referring to FIG. 9)

$$\frac{1}{s_0} + \frac{1}{s_i + \Delta} = \frac{1}{f} \quad \text{(xiv)}$$

$$\frac{d_s/2}{\Delta} = \frac{h}{s_l + \Delta} \quad \text{(xv)}$$

The maximal angle a ray can make horizontally and still encounter the slit is $$\theta = \frac{h}{s_0} = \frac{d_s/2}{s_0 s_1}\frac{1}{\varepsilon} \quad \text{(xvi)}$$

where $$\varepsilon = \left|\frac{1}{s_0} + \frac{1}{s_1} - \frac{1}{f}\right| \quad \text{(xvii)}$$

The absolute value makes the relation valid even if the focus lies in front of the slit, However, h must not be greater than the height of the lens, $y_d$, in which case the ray would miss the lens entirely. In the absence of the lens, the fraction of the x-rays emitted by the source that would encounter the slit would be (the normalization factor I/2π is omitted)

$$I_0 = \frac{d}{s_0 + s_i} \quad \text{(xviii)}$$

With the lens present, but with no absorption of the x-rays, this would be increased to $$I_{lens} = \theta \quad \text{(ixx)}$$

Including absorption, the flux falling on the slit is given by an integral over the angle α of the ray from the source;

$$I_{lens}^{abs} = \int_{-\min(\theta, y_d/s_0)}^{\min(\theta, y_d/s_0)} \exp\left(\frac{-s_0^2\alpha^2}{2\sigma^2}\right)d\alpha \quad \text{(xx)}$$

Here a simplification is made. The aperture is limited either by θ or by $y_d = s_0$. However, even in the last case integration is made to θ. This is a good approximation, since rays that far from the optical axis will be strongly absorbed and only have a small contribution to the flux.

$$I_{lens}^{abs} = \sqrt{2\pi}\,\sigma\frac{1}{s_0}\mathrm{erf}\left(\frac{\theta s_0 1}{\sqrt{2}\,\sigma}\right) = \sqrt{2\pi}\,\sigma\frac{1}{s_0}\mathrm{erf}\left(\frac{d_s}{2\sigma s_i \varepsilon\sqrt{2}}\right) \quad \text{(xxi)}$$

The gain will be $$G(0) = I_{lens}^{abs}/I_0 = \sqrt{2\pi}\,\frac{s_0 + s_i}{s_l}\frac{\sigma}{d_s}\mathrm{erf}\left(\frac{d_s}{2\sqrt{2}\,\sigma\varepsilon s_i}\right) \quad \text{(xxii)}$$

Now assuming that the point source is located at $y_s$ from the optical axis and a similar geometrical exercise gives (omitting the algebraic details)

$$G(y_s) = \sqrt{\frac{\pi}{2}}\,\frac{s_0 + s_i}{s_0}\,\frac{\sigma}{d_s}\left[\mathrm{erf}\left(\frac{d_s}{2\sqrt{2}\,\sigma\varepsilon s_l} + \frac{y_s}{2\sqrt{2}\,\sigma\varepsilon s_0}\right) - \mathrm{erf}\left(-\frac{d_s}{2\sqrt{2}\,\sigma\varepsilon s_i} + \frac{y_s}{2\sqrt{2}\,\sigma\varepsilon s_0}\right)\right] \quad \text{(xxiii)}$$

It is interesting to study how the maximal gain depends on the material properties of the lens. From Eqs. xi and xiii is obtained $$\text{Max gain } \alpha\sigma = \mathrm{sqrt}\{f\delta\lambda\} \quad \text{(xxiv)}$$

and thus $\delta\lambda$ should be maximized. The attenuation length is a strong function of the atomic number and it is obvious a material with the lowest possible Z is interested. In this energy region it is a good approximation to take $\delta \propto E^{-2}$ and a parameterization of the X-ray cross-section in barns ($\propto$½) is (from fitting totabulated values)

$$24.15Z^{4.2}E^{-9} + 0.56Z \quad \text{(xxv)}$$

where the two terms Z and E are photo and Compton effect, respectively (E in keV). Then the optimum energy may be calculated using:

$$d/dE(\delta, \lambda) = 0 = E_{opt} = 2.78Z^{1.07}\ \text{keV} \quad \text{(xxvi)}$$

For example for Beryllium and PMMA, the optimal energies are 12 keV and 19 keV, respectively. PVC with a higher effective Z and thus lower contribution from Compton scattering has a much higher optimum around 48 keV. While PMMA is 3 times better than vinyl at 18 keV, it is only 84% better at 40 keV. This is due to the high Compton scattering at high energies for the very low-Z materials.

DETAILED DESCRIPTION OF THE EMBODIMENTS

Figure 1:
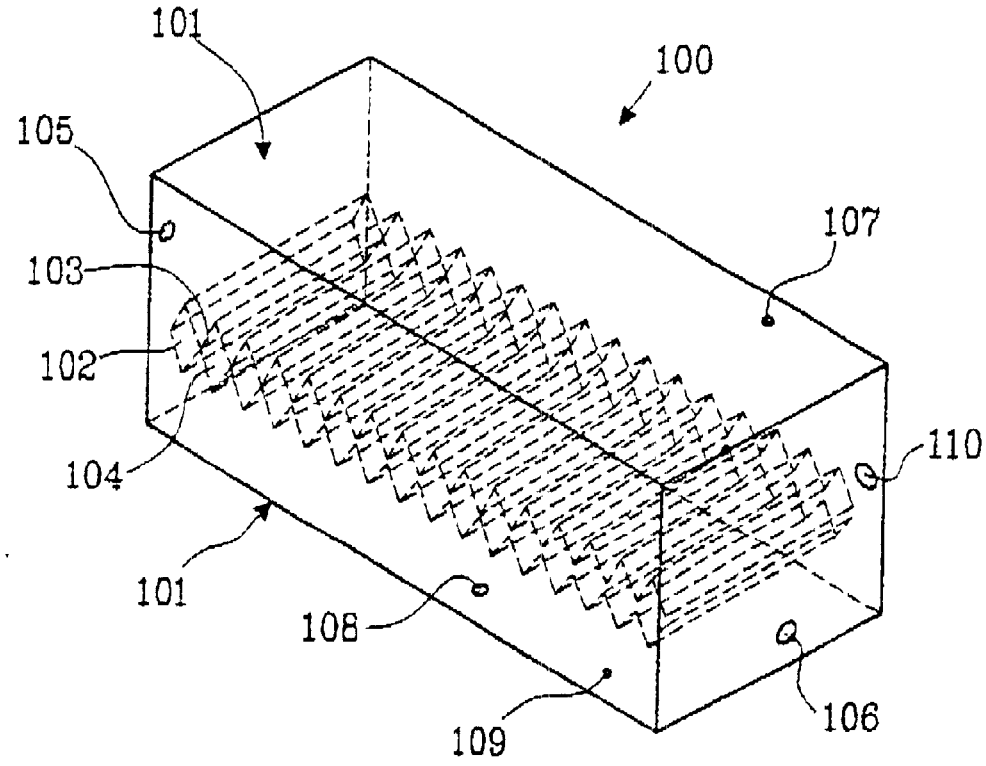
FIG. 1 is a schematic perspective view of a refractive x-ray lens in accordance with one embodiment of the present invention.

A refracting arrangement, which can be used as a lens in x-ray applications is schematically illustrated in FIG. 1. The arrangement 100, hereinafter referred to as lens, comprises a volume having a first end 105, a second end 106 opposite said first end 105, and longitudinal surfaces 107-110. Within the volume are arranged cavities 102 extending substantially from said first end 105 to said second end 106. The cavities are so arranged that the longitudinal axis of each cavity is substantially parallel to the said first and second ends.

Each cavity 102 comprises a first (e.g. upper) and a second (e.g. lower) ridge shaped groove 103 and 104, which consecutively form a sawtooth formed first (e.g. upper) and a second (e.g. lower) lens sections 101. The theory behind the design of the cavities is described above.

During the operation, the lens 100 is arranged to receive X-rays, e.g. through the first end 105, and the X-rays after being refracted are emerged from the second end 106.

Preferably, the volume material should have an atomic number as low as possible, i.e. a low Z-material; good candidates are, e.g. beryllium and plastics such as polymethylmethacrylate (PMMA).

Figure 2:
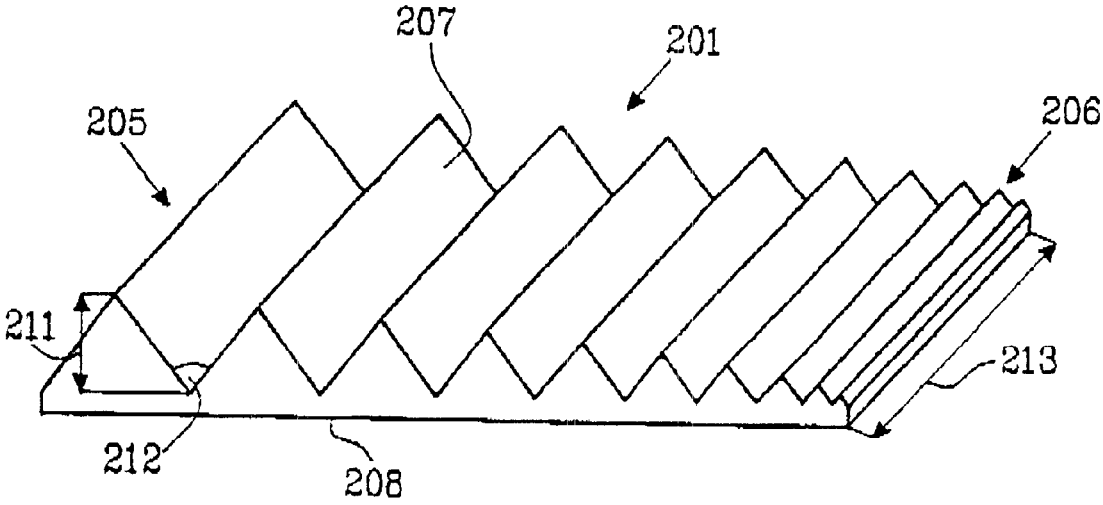
FIG. 2 is a schematic perspective view of a section of a sawtooth profile refractive x-ray lens in accordance with a second embodiment of the present invention.

In FIG. 2, a section 201 (e.g. lower part) of another sawtooth profiled refractive x-ray lens according to the present invention is illustrated. Sawtooth shaped grooves are arranged on one surface 207 of the section while the opposite surface 208 is plane. According to this embodiment, the size of the grooves 203 vary by decreasing the depth of the grooves is linearly from a first end 205 towards a the second end 206 of the volume. In a preferred embodiment the section contains, e.g. approximately 300 straight cut grooves with depth 211 decreasing linearly from about 100 to 0 microns and a bottom angle 212 of approximately 90°. This will give a total length of 30 mm. However, the bottom angle is a free parameter and can be optimized with respect to practical and manufacturing issues. The width 213 of the section can be varied according to the requirements, ranging from mm to dm.

Figure 3A:
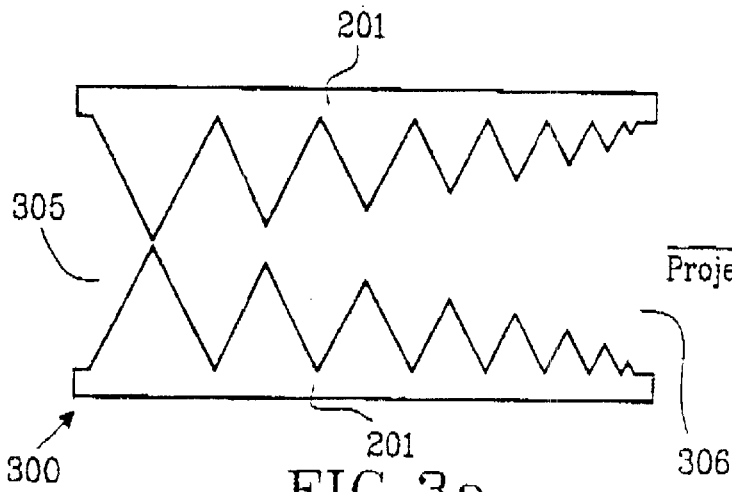
FIG. 3*a* is a schematic side view of the sawtooth profile refractive x-ray lens comprising the sections according to FIG. 2.

In one embodiment, the invention is a split saw-tooth profile refractive x-ray lens. FIG. 3*a* shows a cut through an embodiment of the lens 300 consisting of two sections 201 according to FIG. 2. The sawtooth profile refractive x-ray lens includes two volumes 201 of low-Z material, placed on opposite sides of the optical axis. The volumes 201 of low-Z material form a first end 305 that receives x-rays, preferably of commercially-applicable power emitted from a commercial-grade x-ray source. From the opposite, second end 306 the x-rays emerge. The plurality of grooves are oriented such that the x-rays which are received at the first surface, pass through the volume of low-Z material and through the plurality of grooves. In so doing, the x-rays of a single energy that emerge are refracted to a single focal point. If the x-ray source emits x-rays of variable energy, the spectrum of x-rays received at a single focal point will be enhanced near a unique energy.

Figure 3B:
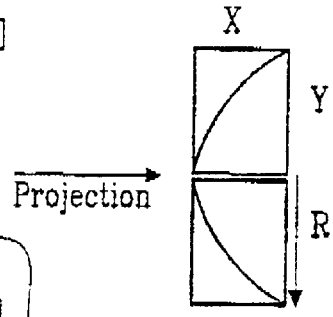
FIG. 3*b* is an imaginary projection showing the parabolic lenticular shape achieved with the sawtooth shape.

The projection of the amount of traversed material for an X-ray entering parallel to the optical axis will be a parabolic profile, as illustrated in FIG. 3*b*. Thus, in principal, the described geometry could be replaced by a single parabolic surface, given by the equation $$x = \frac{y^2}{2R} \quad (4)$$

where R is the radius of curvature and x and y are defined in FIG. 3*a*. This, however, would be extremely difficult to manufacture. One can look at the present invention as a redistribution of the low-Z material to simplify fabrication. With the geometry described above, R=0.167 m. Assume that the low-Z material is beryllium, for which $d=8.5\times10^{-7}$ at 20 keV. This will, according to Eq. 2, give a focal length F=195 mm for 20 keV X-rays. Consequently, unlike the meter-level focal lengths associated with prior art experimental high-energy X-ray focusing devices, the sawtooth profile refractive X-ray lens 300 of the present embodiment attains a focal length on the order of decimeters.

Figure 4:
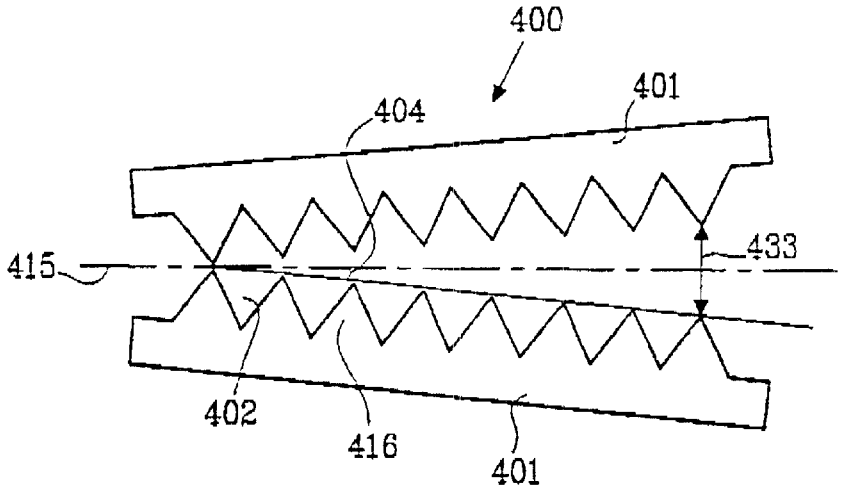
FIG. 4 is a schematic side view of a refractive x-ray lens in accordance with a second embodiment.

In the embodiment outlined in FIG. 4, the lens 400 comprises to sections 401, in which the jags (teeth) 416 all have the same size. By slightly tilting the parts 401 with respect to the optical axis 415, the similar focusing behaviour as in FIG. 3 is achieved. The depth of the grooves is, e.g. about 100 mm. To achieve the same focusing properties as in the previous embodiment, still 300 sawteeth are needed, but the total length of the sawtooth profile refractive lens will be doubled to 60 mm. The separation 413 should be twice the depth of the grooves, i.e. 200 mm. This will give a tilt angle 414 of about 0.1°. These volumes of low-Z material will be substantially easier to manufacture than other geometries. In this embodiment the lens is a tunable sawtooth profile refractive x-ray lens. The volumes 401 of low-Z material including the plurality of straight-cut grooves, through which the x-rays pass, each has thus a small angle to the optical axis. The focal length will be a function of this angle. By varying the angle 414, the focal point for a given energy will be translated. Alternatively, by varying the angle, at a fixed point, the energy at which the spectrum is enhanced will consequently be varied.

Figure 5:
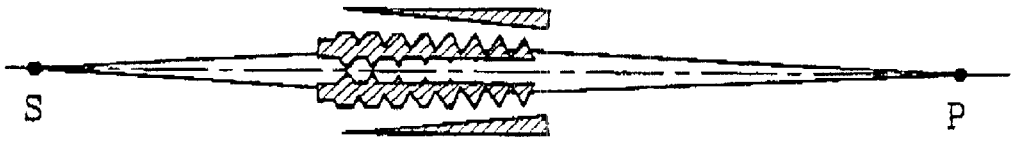
FIG. 5 is a side view of the one-dimensional focusing geometry of the sawtooth profile refractive x-ray lens in accordance with the embodiment shown in FIG. 4, FIGS. 6*a* and 6*b* show the side and the top views, receptively, of another embodiment.

FIG. 5 is a side view of a one-dimensional focusing geometry of the sawtooth profile refractive x-ray lens 500 in accordance with the embodiment shown in FIG. 4. A divergent beam from a source S is focussed to a line at the focal point P. The lense according to this embodiment comprises two halves of refractive arrangements which are designed with sawteeth on both faces of the volume instead of only one face. This design may further improve the focusing properties of the lens.

Figure 6A:
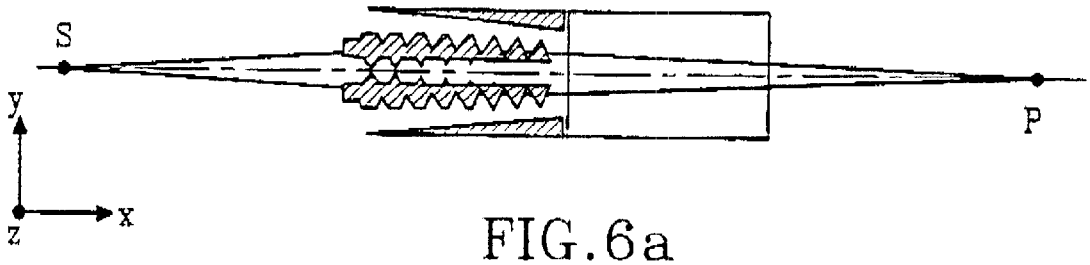
Figure 6B:
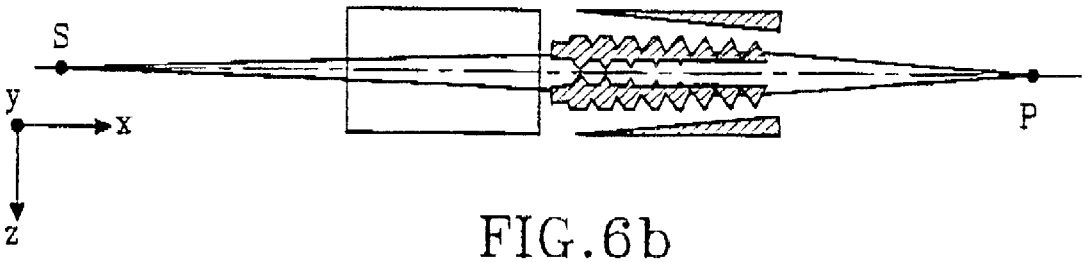

FIGS. 6*a* and 6*b* show the side and the top view, respectively, of an embodiment in which two sawtooth profile refractive lenses 600*a* and 600*b* are used to achieve two-dimensional focusing. The second sawtooth profile refractive lens 600*b* is rotated 90° around the optical axis with respect to the first one 600*a*. A divergent beam from the source S is focussed to a point at the focal point P.

In still another embodiment (not shown), the present invention recites a method for providing a dual energy distribution from an x-ray source using a sawtooth profile refractive leas. In such an embodiment, the sawtooth profile refractive x-ray lens includes two volumes of low-Z material, placed on opposite sides of the optical axis. The volumes of low-Z material include a plurality of straight-cut grooves through which the x-rays will pass. Each of the volumes has a small unique angle to the optical axis. By having different angles for the two halves, each half will have a separate focal point. At a given point on the optical axis, the x-ray spectrum will he enhanced at two separate energies and thus yield a bimodal energy distribution.

According to one preferred method for manufacturing a lens of the invention, the shape of the grooves are transferred onto a (e.g. plastic) carrier by means of an engraving machine, comprising a hot engraving pointer which is controlled by a controlling arrangement transferring the shape of the grooves on to the carrier. Then a (metallic) master is formed using the carrier. The master may be used directly or through intermediate steps to make pressing moulds for pressing the grooves on suitable material.

Accordingly, the sawtooth lens resembles a vinyl phonograph record. A rough calculation gives that the groove pitch of such a record should be around 120 $\mu$m (10 cm at 33 rpm in 25 min). In order to have the dimensions of vibration decoupled, the bottom angle must be 90° in stereo mode, i.e. $\beta$ as defined in the "BASIC THEORY" section is 45°. Thus, if there were no inter-spacing between the grooves, the depth would be 60 $\mu$m. Measurements of the profile of a vinyl record indicated that inter-spacing takes up half of the surface, which gives a depth of only 30 $\mu$m. However, the cutting is a flexible process with many free parameters. The restriction is the 100 $\mu$m lacquer layer on the master that limits the depth to about 90 $\mu$m and consequently the width to 180 $\mu$m. A master was cut with a depth of 90° without inter-spacing and a vinyl (PVC) was record-pressed, from which 60 mm long sections were cut out. The surface of the cuts seems to be of rather bad quality and the gain should be expected to be non-optimal. The lens halves were attached to aluminum supports that were adjusted with micrometer screws under a microscope to give the right tilt angle. With, 180 $\mu$m separation at the end, the radius of curvature is R=(90 $\mu$m) 2=(2/Delta 300 mm)=0:135 $\mu$m. This gives a focal length of 218 mm for 23 keV.

Above-mentioned methods are given merely as examples and other methods may also be used such as diamond turning techniques, laser cutting etc.

The lenses according to the invention may be used in all x-ray applications, such as mammography, bone-density analysis, dental applications, x-ray microscopy or crystallography etc.

Figure 10:
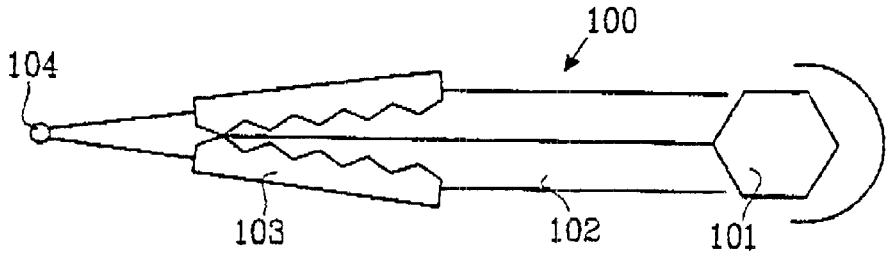
FIG. 10 is a schematic illustration of an arrangement for crystallographical application comprising a lens according to the present invention, and FIGS. 11 and 12*a* schematic illustration of an microscope involving a lens according to the present invention.

In an x-ray crystallography arrangement 100, as shown in FIG. 10, the crystal structure of a sample 101 is determined by detecting the spatial pattern of a diffracted x-ray beam 102 incident on the sample 101. The divergent beam from a small x-ray source 104 is projected onto the crystal sample by the lens 103. It is important that the incident beam has a low divergence (cross-fire), more precisely lower or equal to the mosaic spread of the crystal 101. Thus, the saw-tooth refractive x-ray lens 103 can be applied to x-ray crystallography. Due to the geometry, the beam incident on the sample has a very small divergence. By this, a gain of flux on the sample is obtained and thus image acquisition time is decreased. The minimum distance from source to sample is determined by the constraint on beam divergence. Typical parameters would be:

Source size: 20 microns

Sample size: 100 microns

Source-to-lens distance: 15 cm

Lens-sample distance: 75 cm

Since the lens is chromatic, a narrow energy peak can be selected from a broad x-ray spectrum from the source. This will enhance the image quality and signal-to-noise ratio. This versatility can be used to choose the optimal energy for every sample.

Ideally, two lenses arranged in series could be used to obtain two-dimensional focusing and squared gain.

Figure 11:
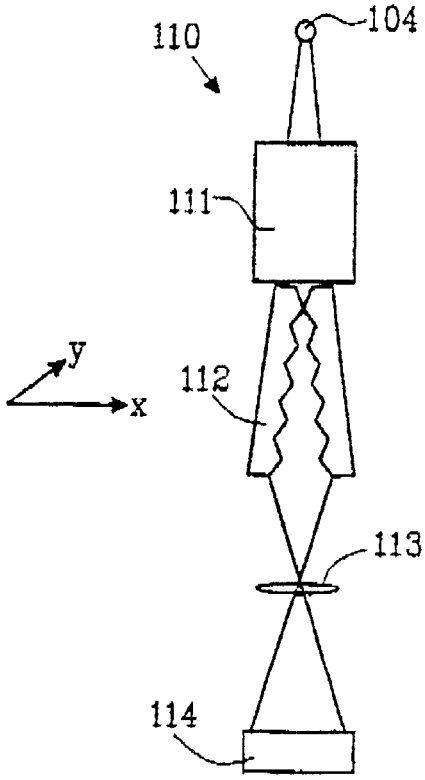
Figure 12:
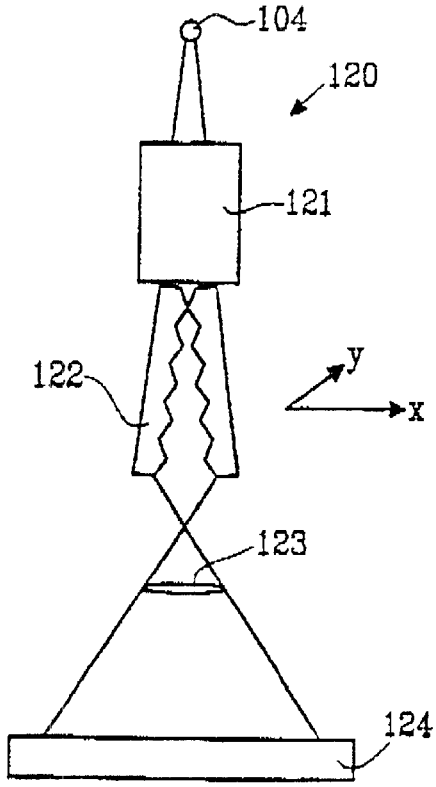

Another application is an x-ray microscope, as shown FIGS. 11 and 12. The lens can be used to form the lens of the x-ray microscope 110 and 120. In both cases two lenses 111, 112, 121 and 122 are used to focus the x-ray beam to a very small spot, typically smaller than a few microns. In the arrangement of FIG. 11 the sample 113 is placed in the focal plane. The transmitted beam is incident upon a single x-ray detector 114. To obtain a full two-dimensional image the object must be scanned point-by-point by a translational stage. The first lens 111 focuses the beam in y direction and the second lens 112 focuses the beam in x direction In the arrangement according to FIG. 12, the sample 123 is stationary and positioned below (or above) the focal point of the lens. A magnified image of the object is seen by a pixelated area detector 124 and no scanning is needed.

While the invention is described in conjunction with the preferred embodiments, it is appreciated that there is no intend to limit the invention to these embodiments. On the contrary, the invention is intended to cover alternatives, modifications and equivalents, which may be included within the scope of the invention as defined by the appended claims.

What is claimed is:

1. A refractive arrangement for X-rays comprising: a member of low-Z material, said member of low-Z material having a first end adapted to receive X-rays emitted from an X-ray source and a second end from which said X-rays, received at said first end, emerge and first and second surfaces wherein said arrangement further comprises a plurality of substantially sawtooth formed triangular grooves disposed, between at least part of said first end and second end, on at least one of said first or second surfaces, said plurality of grooves oriented such that said X-rays, which are received at said first end, pass through said member of low-Z material and said plurality of grooves, and emerge from said second end, are refracted to a focal point.

2. The arrangement of claim 1, characterized in, that said member of low-Z material consists of a plastic material, specially one of from the group comprising polymethylmethacrylate, vinyl and PVC.

3. The arrangement of claim 1, characterized in, that said member of low-Z material consists of beryllium.

4. The arrangement according to claim 1, characterized in, that said grooves have the form of sawteeth with substantially straight cuts.

5. The arrangement according to claim 1, characterized in, that said pluralities of grooves have varying sizes, decreasing or increasing continuously from said first end towards said second end.

6. A mammography x-ray apparatus including a refractive arrangement according to claim 1.

7. A refractive X-ray lens comprising: a volume of low-Z material, said volume having a first end adapted to receive X-rays emitted from an X-ray source and a second end from which said X-rays received at said first end, emerge and first and second surfaces wherein said volume further comprises a plurality of substantially sawtooth formed triangular grooves disposed between at least part of said first end and second end, on at least one of said first and second surfaces, said plurality of grooves oriented such that said X-rays which are received at said first end, pass through said volume of low-Z material and said plurality of grooves, and emerge from said second end, are refracted to a focal point.

8. The lens according to claim 7, characterized in that the lens comprises of two volumes arranged such that the surfaces with the plurality of grooves are facing each other.

9. The lens according to claim 8, characterized in that said two volumes each have a tilt angle to an optical axis of said X-ray.

10. The lens according to claim 9, characterized in that a focal length of each of the two volumes of the lens is varied by separately varying each tilt angle.

11. The lens according to claim 9, characterized in, that said volume of low-Z material consists of beryllium.

12. The lens according to claim 8, characterized in that said volumes have non-coincident focal points.

13. The lens according to claim 7, characterized in that said volume of low-Z material consists of a plastic material, specially one from the group comprising polymethylmethacrylate, vinyl or PVC.

14. An X-ray system for two-dimensional focusing of X-rays and including at least two lenses according to claim 7, characterized in that the focusing is obtained by arranging said at least two lenses, such that each x-ray traverses both of lenses in sequence and that one of said at least two lenses are rotated around an optical axis with respect to the other lens.

15. A method of providing two-dimensional focusing by using two saw-tooth profile refractive x-ray lenses according to claim 7, such that each x-ray will traverse both of them in sequence and such that the said second saw-tooth profile refractive x-ray lens is rotated around the optical axis with respect to the said first saw-tooth profile refractive x-ray lens.

16. The lens of claim 7, characterized in that said refractive lens is coupled to at least one second commercial-grade compound refractive x-ray lens such that an array of compound refractive x-ray lenses is formed.

17. A method for providing a bimodal energy distribution from an X-ray source using the saw-tooth profile refractive x-ray lens of claim 7.

18. A mammography x-ray apparatus including a lens arrangement according to claim 7.

19. An x-ray crystallography arrangement including a lens arrangement according to claim 7.

20. An x-ray microscope arrangement including a lens arrangement according to claim 7.

21. A method for fabricating a sawtooth triangular profile refractive X-ray lens wherein transferring shapes of triangular grooves onto a carrier by means of an engraving arrangement is performed, producing a master, and using said master for pressing grooves on a suitable material.

22. The method according to claim 21, characterized in that said material is vinyl or PVC.

23. A refractive arrangement for X-rays comprising: a member of low-Z material, said member of low-Z material having a first end adapted to receive X-rays emitted from an X-ray source and a second end from which emerge said X-rays received at said first end, and first and second surfaces characterized in that it further comprises a plurality of substantially sawtooth formed grooves disposed between said first and second ends on at least one of said first or second surfaces, said plurality of grooves oriented such that said X-rays which are received at said first end, pass through said member of low-Z material and said plurality of grooves, and emerge from said second end, are refracted to a focal point, further characterized in that said pluralities of grooves have varying sizes, decreasing or increasing continuously from said first end towards said second end.

24. A refractive X-ray lens comprising: a volume of low-Z material, said volume having a first end adapted to receive X-rays emitted from an X-ray source and a second end from which emerge said X-rays received at said first end and first and second surfaces, characterized in that said volume further comprises a plurality of substantially saw-tooth formed grooves disposed between said first and second ends on at least one of said at least two surfaces, said plurality of grooves oriented such that said X-rays which are received at said first end, pass through said volume of low-Z material and said plurality of grooves, and emerge from said second end, are refracted to a focal point, further characterized in that the lens comprises of two volumes arranged such that the surfaces with the plurality of grooves are facing each other, further characterized in that said two volumes each have a tilt angle relative to an optical axis of said X-ray.

25. A refractive X-ray lens comprising: a volume of low-Z material, said volume having a first end adapted to receive X-rays emitted from an X-ray source and a second end from which emerge said X-rays received at said first end and first and second surfaces, characterized in that said volume further comprises a plurality of substantially saw-tooth formed grooves disposed between said first and second ends on at least one of said at least two surfaces, said plurality of grooves oriented such that said X-rays which are received at said first end, pass through said volume of low-Z material and said plurality of grooves, and emerge from said second end, are refracted to a focal point, further characterized in that the lens comprises of two volumes arranged such that the surfaces with the plurality of grooves are facing each other, further characterized in that said volumes have non-coincident focal points.

26. The lens according to claim 24, characterized in that a focal length of each of the two volumes of the lens is varied by separately varying each tilt angle.

27. The lens according to claim 24, characterized in that said volume of low-Z material consists of beryllium.

28. An X-ray system for two-dimensional focusing of X-rays and including at least two refractive X-ray lenses, each lens comprising: a volume of low-Z material, said volume having a first end adapted to receive X-rays emitted from an X-ray source and a second end from which emerge said X-rays received at said first end and first and second surfaces, characterized in that said volume further comprises a plurality of substantially saw-tooth formed grooves disposed between said first and second ends on at least one of said at least two surfaces, said plurality of grooves oriented such that said X-rays which are received at said first end, pass through said volume of low-Z material and said plurality of grooves, and emerge from said second end, are refracted to a focal point, characterized in that the focusing is obtained by arranging said at least two lenses, such that each X-ray traverses both of lenses in sequence and that one of said at least two lenses is rotated around an optical axis with respect to the other lens.

29. A method of providing two-dimensional focusing by using two saw-tooth profile refractive X-ray lenses, each lens comprising: a volume of low-Z material, said volume having a first end adapted to receive X-rays emitted from an X-ray source and a second end from which emerge said X-rays received at said first end and first and second surfaces, characterized in that said volume further comprises a plurality of substantially saw-tooth formed grooves disposed between said first and second ends on at least one of said at least two surfaces, said plurality of grooves oriented such that said X-rays which are received at said first end, pass through said volume of low-Z material and said plurality of grooves, and emerge from said second end, are refracted to a focal point, such that each X-ray will traverse both of them in sequence and such that the said second saw-tooth profile refractive X-ray lens is rotated around ab optical axis with respect to the said first saw-tooth profile refractive X-ray lens.

30. A refractive X-ray lens comprising: a volume of low-Z material, said volume having a first end adapted to receive X-rays emitted from an X-ray source and a second end from which emerge said X-rays received at said first end and first and second surfaces, characterized in that said volume further comprises a plurality of substantially saw-tooth formed grooves disposed between said first and second ends on at least one of said at least two surfaces, said plurality of grooves oriented such that said X-rays which are received at said first end, pass through said volume of low-Z material and said plurality of grooves, and emerge from said second end, are refracted to a focal point, further characterized in that said refractive lens is coupled to at least one second commercial-grade compound refractive X-ray lens such that an array of compound refractive X-ray lenses is formed.

* * * * *